US005408230A

United States Patent [19]

Okita

[11] Patent Number: 5,408,230

[45] Date of Patent: Apr. 18, 1995

[54] REMOTE CONTROL SYSTEM FOR MARINE PROPULSION UNIT

[75] Inventor: Ryozo Okita, Shizuoka, Japan

[73] Assignee: Sanshin Kogyo Kabushiki Kaisha, Hamamatsu, Japan

[21] Appl. No.: 643,434

[22] Filed: Jan. 22, 1991

[30] Foreign Application Priority Data

Jan. 26, 1990 [JP] Japan ..... 2-15012

[51] Int. Cl.[6] ..... B63H 21/21

[52] U.S. Cl. ..... 340/825; 440/84; 114/144 A; 318/588; 318/591

[58] Field of Search ..... 340/825.69, 825; 114/144 R, 144 E, 144 A; 440/84, 85, 86, 87; 361/192; 180/321, 287, 6.26, 6.3; 318/588, 591; 244/196

[56] References Cited

U.S. PATENT DOCUMENTS

| | | | |
|---|---|---|---|
| 4,480,571 | 11/1984 | Meyer | 114/146 |
| 4,836,809 | 6/1989 | Pelligrino | 440/84 |
| 4,925,416 | 5/1990 | Oishi | 440/87 |
| 5,031,562 | 7/1991 | Nakase et al. | 244/196 |

*Primary Examiner*—Michael Horabik

*Attorney, Agent, or Firm*—Ernest A. Beutler

[57] ABSTRACT

A remote control system is provided for transmitting control movement from a remote control unit to a controlled element which includes a throttle or transmission control lever on a marine propulsion unit. An operator is associated with the remote control unit and is movable between a plurality of positions. The remote control system further includes a pair of detectors, one in proximity to the remote control unit for transmitting an electrical signal to a controlling unit indicative of the detected position of the operator, and the other positioned in proximity to the controlled element for transmitting an electrical signal to the controlling unit indicative of the detected position of the controlled element. An electric actuator which includes an electric motor is controlled by the controlling unit on the basis of the electrical signals received by the controlling unit to effect movement of the throttle or transmission control lever so that the position of the control lever corresponds with the position of the operator. If the electrical system should fail, however, a manual actuator which includes a lever is provided for manually effecting movement of the control lever.

5 Claims, 3 Drawing Sheets

REMOTE CONTROL SYSTEM FOR MARINE PROPULSION UNIT

BACKGROUND OF THE INVENTION

This invention relates to a remote control system for a marine propulsion unit, and more particularly to an improved remote control system which includes electric actuating means for actuating a controlled member, such as a throttle or transmission control lever on the propulsion unit, by movement of an operator, and which further includes manual actuating means for actuating the controlled member in the event of an electrical failure.

One type of remote control arrangement has been proposed which is employed on certain watercraft to electrically operate a controlled member on an associated marine propulsion unit. With this type of arrangement, movement of a remote operator effects movement of the controlled member through an electric actuator which is powered by a storage battery on the watercraft. While this type of arrangement is generally satisfactory in reducing the operational load normally associated with purely mechanically operated remote control systems, it has a disadvantage in that no means are provided on the watercraft for manually operating the controlled member should that become necessary to maintain control of the watercraft in the event of an electrical component or power failure.

It is, therefore, a principal object of this invention to provide an improved remote control system for a marine propulsion unit which includes electric actuating means for actuating a controlled member on the propulsion unit under normal circumstances, and which further includes manual actuating means for actuating the controlled member when the electric actuating means becomes inoperable so as to prevent the watercraft from running out of control.

It is a further object of this invention to provide an improved remote control system for a marine propulsion unit wherein a clutch is provided for disengaging the manual actuating means from the electric actuating means so that the manual actuating means can be manually operated without resistance from the electric actuating means.

SUMMARY OF THE INVENTION

This invention is adapted to be embodied in a remote control system for transmitting control movement to a controlled element and which includes a controlling unit and a remote control unit having an operator movable between a plurality of positions. The system further includes means for detecting the position of the operator and outputting a signal to the controlling unit indicative of the detected position of the operator, as well as means for detecting the position of the controlled element and outputting a signal to the controlling unit indicative of the detected position of the controlled element. An actuator unit is provided which includes electric actuating means for actuating the controlled element on the basis of the signals received by the controlling unit and further includes manual actuating means for actuating the controlled element manually.

DETAILED DESCRIPTION OF THE PREFERRED EMBODIMENTS OF THE INVENTION

Figure 1:
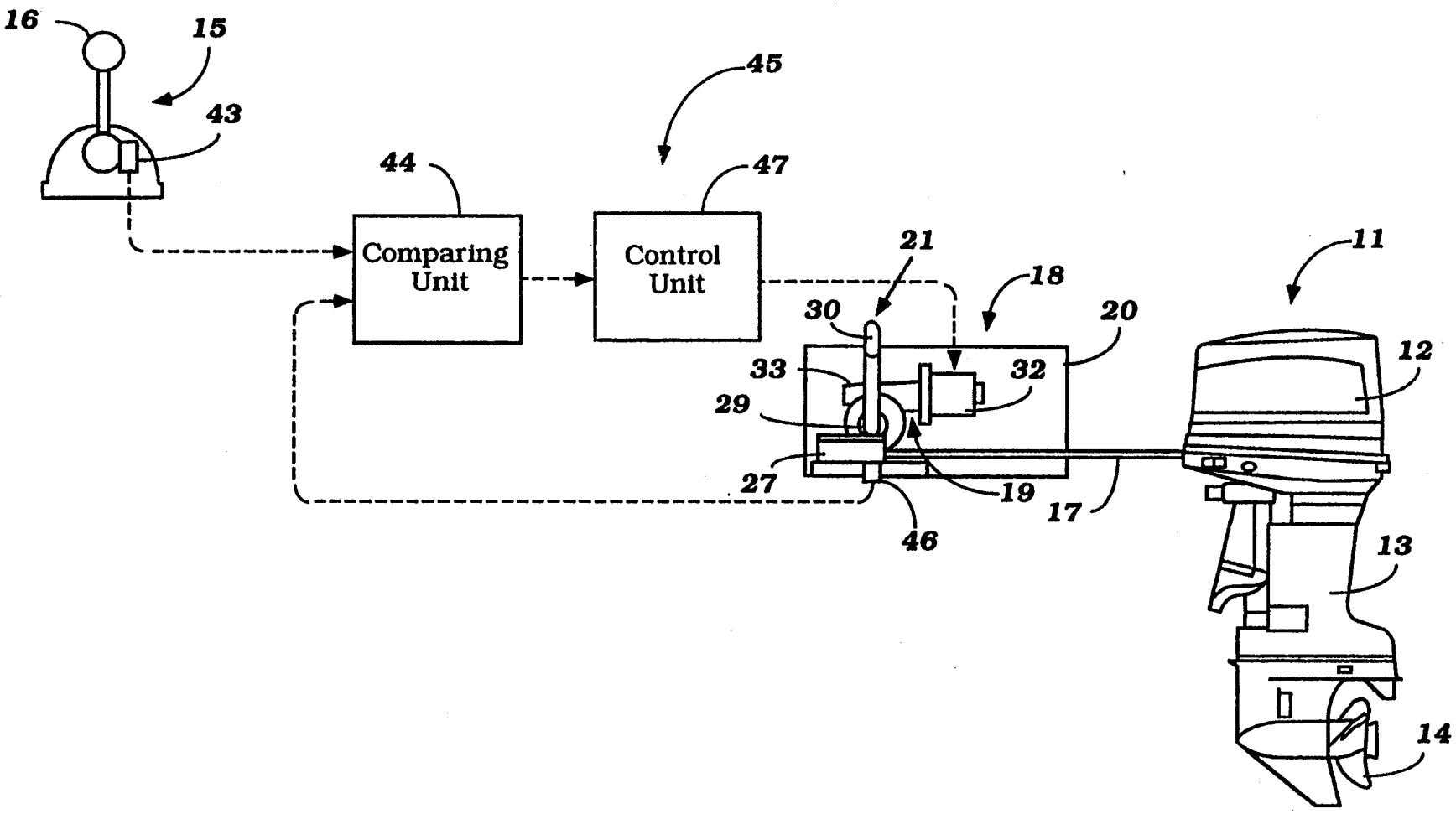
FIG. 1 is a partially perspective and partially schematic view of a remote control system constructed and operated in accordance with an embodiment of the invention.

Referring first to FIG. 1, a remote control system for operating a marine propulsion unit from a remote location is depicted. In the illustrated embodiment the marine propulsion unit, which is identified generally by the reference numeral 11, comprises an outboard motor. However, it should be noted that the marine propulsion unit 11 may alternatively comprise the outboard drive portion of an inboard/outboard drive unit.

In the illustrated embodiment, the marine propulsion unit 11 includes a power head 12 that contains an internal combustion engine (not shown) and which is surrounded by a protective cowling. The internal combustion engine drives an output shaft which, in turn, drives a driveshaft that is journaled for rotation within a driveshaft housing 13 that depends from the power head 12. This driveshaft (not shown) drives a propeller 14 of a lower unit by means of a conventional forward, neutral, reverse transmission of the type used with such propulsion units and which may be operated in accordance with an embodiment of the invention.

A remote control unit 15 comprised of an operator 16 pivotally mounted on a base is provided for controlling either a throttle or transmission control lever on the marine propulsion unit 11 and is preferably positioned on the bridge of an associated watercraft near the other controls of the watercraft. If the remote control unit 15 is used to control throttle operation, the operator 16 will be movable between an idle position and a fully open throttle position. If, on the other hand, the remote control unit 15 is used to control the transmission, the operator 16 will be movable between neutral, forward and reverse positions.

A cable 17 is connected at one end to the throttle or transmission control lever and is connected at the other end to an actuator unit 18 for actuation of the lever. This actuator unit 18 comprises electric actuating means 19 as well as manual actuating means 21, to be described, for controlling the movement of the lever and thus for controlling the throttling or transmission of the marine propulsion unit 11. The actuator unit 18 and its associated components are contained within a casing 20.

Figure 3:
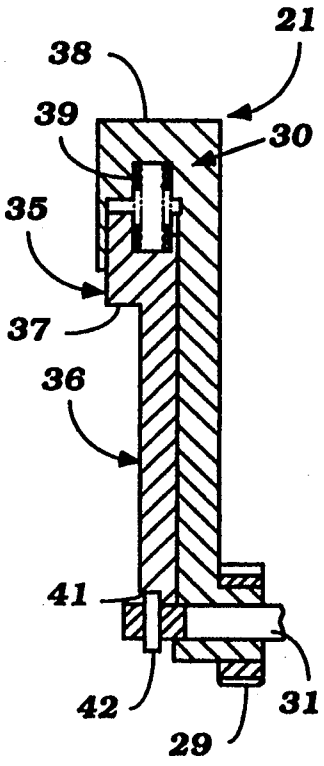
FIG. 3 is a cross-sectional view taken along line III—III in FIG. 2.
Figure 2:
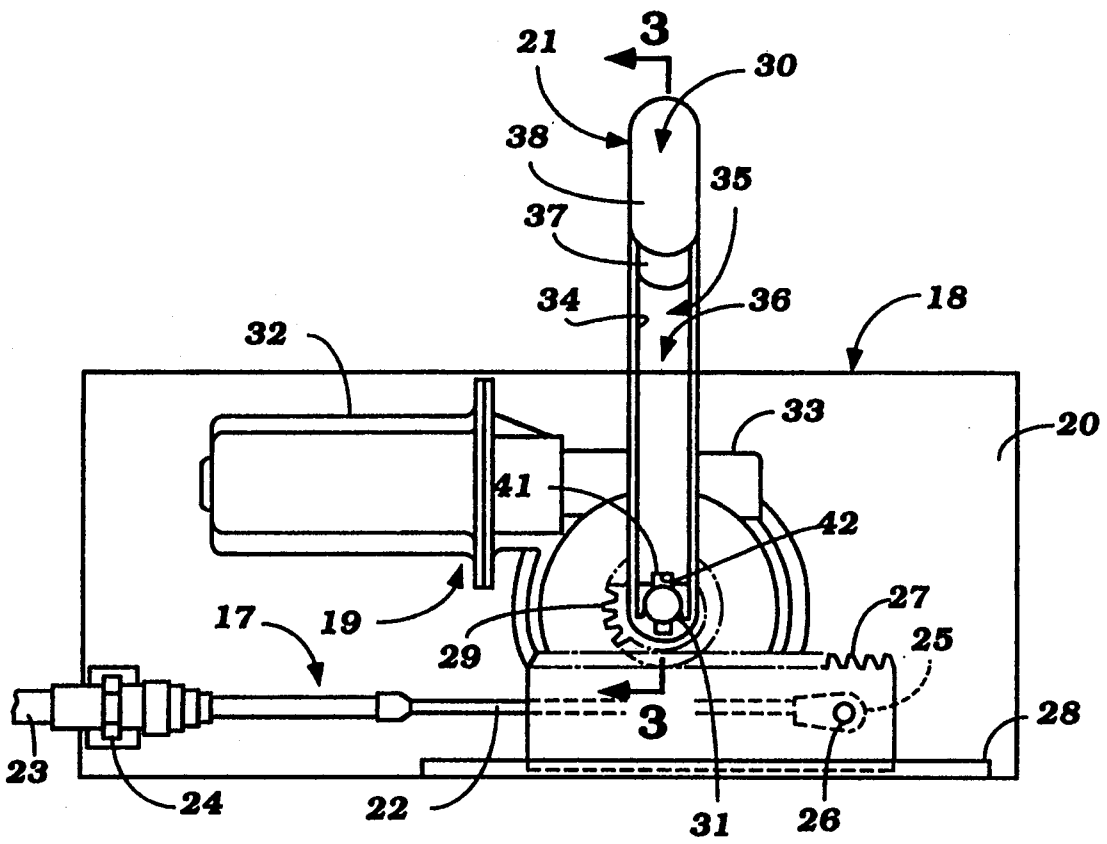
FIG. 2 is a front view of the actuator unit of the remote control system.
Figure 4:
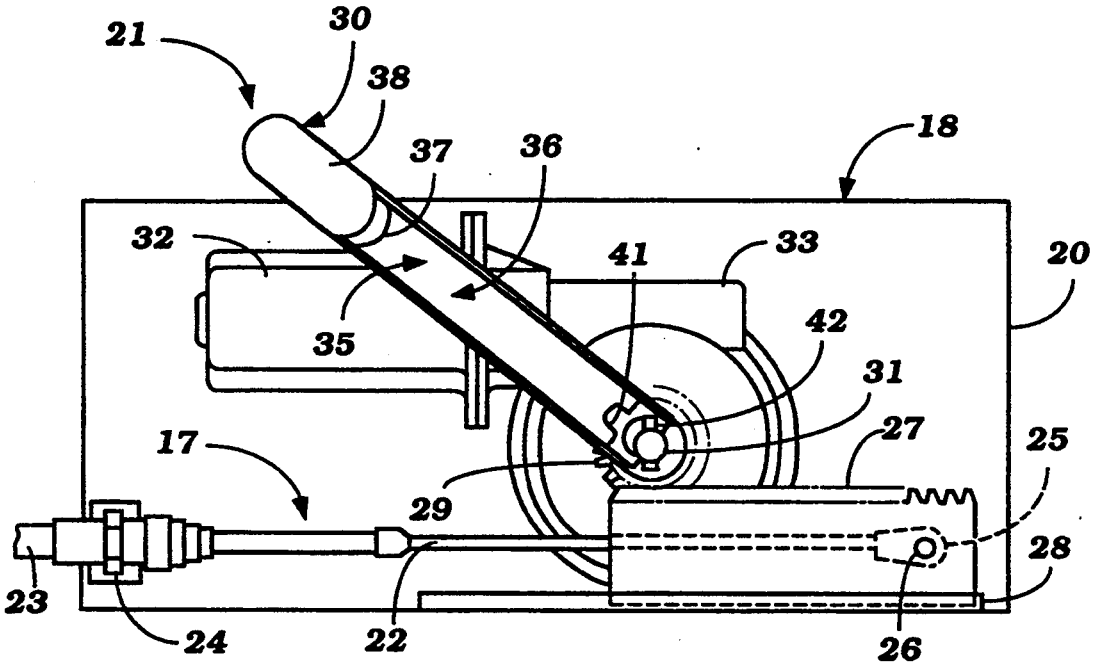
FIG. 4 is a front view of the actuator unit in the manual operating mode.

The manner in which the actuator unit 18 operates to control the throttle or transmission control lever will now be described with particular reference to the remaining FIGS. 2, 3 and 4, in addition to FIG. 1. A bowden wire 22 of cable 17 is connected at one end to the control lever and is slideably moveable within an outer wire cover 23 that is affixed to the actuator unit 18 by a mount 24. The bowden wire 22 has an enlarged portion 25 at its other end for connection by means of a pin 26 to a slide rack 27 which is slideably supported on a base 28. The rack 27 has teeth that are enmeshed with a pinion gear 29 which is rotatably journaled upon a driveshaft 31 and which is also joined to a manual lever 30 of the manual actuating means 21.

An electric motor 32 is coupled to the driveshaft 31 through a reduction gear box assembly 33 and is operated to drive the driveshaft 31 and effect movement of the control lever on the propulsion unit 11 under normal conditions and in a manner to be described.

A clutch assembly, indicated generally by the reference numeral 35, is provided for selectively engaging and disengaging the pinion gears 29 and manual lever 30 with the driveshaft 31, electric motor 32 and gear box 33. It should be noted that the pinion gear 29 and manual lever 30 are joined together to form a single unit and will engage and disengage as a single unit. This clutch 35 includes a latch 36 which is slideably moveable within a recess 34 of the manual lever 30 and which has a latch knob 37 that is received within a larger diameter opening formed within a handle 38 of the manual lever 30. A coil compression spring 39 is interposed between the latch knob 37 and the manual lever handle 38 and is held axially in position at its lower end by an opening formed in the latch knob 37 and at its upper end by a smaller diameter opening which extends upwardly from the larger diameter opening in the handle 38. The coil compression spring 39 acts to bias a grooved portion 41 of the latch 36 into engagement with a pin 42 of the driveshaft 31 so as to normally engage the pinion gear 29 with the electric motor 32 and gear box 33. As a result of this clutch mechanism, the pinion gear 29 can be rotated by the driveshaft 31 or by the manual lever 30 independently of the driveshaft 31 to effect movement of a controlled element which includes the slide rack 27 and the control lever on the propulsion unit 11.

When the electric actuating means 19 is used to control movement of the throttle or transmission control lever, a control position detector 43 positioned in proximity to the remote control unit 15 detects the position of the operator 16 as it is moved and transmits an electrical signal indicative of this detected position to a comparator 44 of a controlling unit, indicated generally by the reference numeral 45. Upon movement of the operator 16, this comparator 44 also receives an electrical signal from a detector 46 which detects the position of the slide rack 27. This electrical signal outputted by the detector 46 is indicative of the detected position of the slide rack 27 and thus the position of the throttle or transmission control lever on the propulsion unit 11 which, as previously noted, is mechanically linked to the slide rack 27 via the cable 17.

In operation, the comparator 44 compares the signals received from the detectors 43 and 46 and outputs a resulting signal to a controller 47 which, in turn, outputs a signal to the electric motor 32. Upon receipt of this signal, the electric motor 32 is operated to drive the driveshaft 31 and pinion gear 29. Movement of the pinion gear 29 causes the rack 27 to slide along its base 28 to effect a push-pull movement on the bowden wire 22 so as to effect movement of the throttle or transmission control lever so that the position of the lever on the propulsion unit 11 corresponds with the position of the operator 16. When the pinion gear 29 and manual lever 30 are engaged with the driveshaft 31 as is the case in the electric actuating mode, the lever 30 will also move in response to operation of the electric motor 32 and driveshaft 31 so as to give a visual indication of the position of the throttle or transmission control lever.

Should it become necessary due to an electrical system failure or desirable to manually operate the throttle or transmission control lever, the operator of the watercraft grasps the handle 38 of the manual lever 30 and urges the latch 36 upward so that its grooved portion 41 becomes disengaged with the driveshaft pin 42. This will free the pinion gear 29 and lever 30 from the resistance of the motor 32 and gear box 33. As a result, only a small force need be applied to the lever 30 to move it forward or backward along a slot formed in the casing 20 in order to manually effect movement of the slide rack 27 and the throttle or transmission control lever.

From the foregoing description it should be readily apparent that the described remote control system is extremely effective for controlling a controlled member such as a throttle or transmission control lever from a remote location under various conditions. The system is arranged to provide for electric control under normal conditions so as to reduce the operational load of the system, but also includes manual actuating means for controlling the controlled member if there is a problem with the electrical system. Although exemplary embodiments of the invention have been illustrated and described, various changes and modifications may be made without departing from the spirit and scope of the invention, as defined by the appended claims.

I claim:

1. A remote control system for transmitting control movement to a controlled element comprising, a controlling unit, a remote control unit having an operator moveable between a plurality of positions, means for detecting the position of said operator and outputting a signal to said controlling unit indicative of the detected position of said operator, means for detecting the position of said controlled element and outputting a signal to said controlling unit indicative of the detected position of said controlled element, and an actuator unit including electric actuating means for actuating said controlled element on the basis of the signals received by said controlling unit wherein said controlling unit provides to the electric actuating means a control signal based on the position signals received by said controlling unit, said actuator unit further including manual actuating means mechanically engaged with said controlled element for actuating said controlled element manually and a pinion operatively connected to said controlled element and said manual actuating means.

2. A remote control system as recited in claim 1, wherein said controlling unit comprises means for comparing the signal outputted by said operator detecting means with the signal outputted by said controlled element detecting means and means for outputting a resulting signal to said electric actuating means for actuating said controlled element on the basis of the resulting signal.

3. A remote control system as recited in claim 1, wherein said electric actuating means comprises an electric motor and a driveshaft operatively connected to said electric motor.

4. A remote control system as recited in claim 3, wherein said actuator unit further comprises a clutch affixed to said manual actuating means and moveable thereon for selectively engaging and disengaging said manual actuating means and said pinion gear from said driveshaft.

5. A remote control system as recited in claim 4, wherein said manual actuating means is a lever.

* * * * *